US005685238A

United States Patent [19]

Chambers

[11] Patent Number: 5,685,238

[45] Date of Patent: Nov. 11, 1997

[54] SHELVING APPARATUS

[75] Inventor: David Anthony Chambers, West Yorkshire, United Kingdom

[73] Assignee: P & G Industries Plc, Warwickshire, United Kingdom

[21] Appl. No.: 637,226

[22] Filed: Apr. 24, 1996

[51] Int. Cl.[6] ..... A47B 3/00

[52] U.S. Cl. ..... 108/193; 108/153; 108/91

[58] Field of Search ..... 128/193, 192, 128/181, 182, 153, 91; 211/194, 189, 186, 135, 188

[56] References Cited

U.S. PATENT DOCUMENTS

| | | | |
|---|---|---|---|
| 2,933,193 | 4/1960 | De Mattia . | |
| 2,990,067 | 6/1961 | Bartlett . | |
| 3,217,894 | 11/1965 | Shewell . | |
| 3,259,079 | 7/1966 | Freeman | 108/192 X |
| 3,294,250 | 12/1966 | Evans . | |
| 4,064,995 | 12/1977 | Bustos | 108/193 X |
| 4,098,197 | 7/1978 | Jorgensen | 108/193 X |
| 4,119,045 | 10/1978 | Michelotti . | |
| 4,408,812 | 10/1983 | Krautwurst | 108/193 X |
| 4,607,576 | 8/1986 | Kranjec . | |
| 4,706,576 | 11/1987 | James | 108/192 |
| 5,174,200 | 12/1992 | Jeandel et al. | 108/193 X |
| 5,463,966 | 11/1995 | Nilsson | 108/193 X |

FOREIGN PATENT DOCUMENTS

| | | |
|---|---|---|
| 0172111 | 2/1986 | European Pat. Off. . |
| 2528296 | of 1982 | France . |
| 1141135 | 1/1969 | United Kingdom . |
| 1155251 | 6/1969 | United Kingdom . |
| 1441065 | 6/1976 | United Kingdom . |
| 1448884 | 9/1976 | United Kingdom . |
| 2260480 | 4/1993 | United Kingdom . |
| 2260481 | 4/1993 | United Kingdom . |
| 2260482 | 4/1993 | United Kingdom . |
| 2281193 | 3/1995 | United Kingdom . |

*Primary Examiner*—Jose V. Chen

*Attorney, Agent, or Firm*—Dann, Dorfman, Herrell and Skillman; Henry H. Skillman

[57] ABSTRACT

Boltless shelving apparatus is described which comprises a number of upright support members (10), and a number of transverse shelf members (12). The shelves are mounted to the supports by insertion of downwardly extending engagement members (32) at the shelf corners into corresponding slots (20) in the uprights. The engagement members and slots preferably both have a generally "L" shaped cross-section, and the shelves may be mounted to the supports simply by downward movement of the engagement members into the slots.

9 Claims, 4 Drawing Sheets

SHELVING APPARATUS

FIELD OF THE INVENTION

The present invention relates to shelving systems, in particular those comprising a plurality of upright supports and a plurality of shelf members mountable to the supports.

Shelving systems of this type commend themselves for use in domestic, office and commercial environments, because of their versatility and ease of use. Customers will typically purchase a set containing a number of shelves and four uprights, each having a plurality of shelf attachment points along its length. The shelving unit may then be constructed to meet the particular use for which it is intended by mounting the shelves at the desired positions on the uprights.

BACKGROUND TO THE INVENTION

Many prior art shelving systems require the use of bolts or other external attachment pieces to mount the shelves to the uprights. For example, in the system described in European Patent Application No. 0,172,111, the shelves are attached to the uprights via corner brackets, by means of bolts. The bolt heads are received in recesses formed on the outer surfaces of the uprights, and the bolts are secured by washers and nuts on the inward facing sides of the uprights. This system has the disadvantage of requiring a large number of parts and is likely to be time-consuming to construct.

An alternative system is described in British Patent Application No. 2,260,482 in which each corner of the shelf has a bracket having two vertically spaced protruding angle pieces, which, when the corner of the shelf is offered up to an upright, extend through corresponding apertures in the upright to form a vertical slot. The shelf corner is secured in position by a locking peg which is driven into the slot, preventing removal of the shelf corner. Though this system uses less pieces than that of European Patent Application No. 0,172,111 and is likely to be somewhat easier to assemble, it nevertheless suffers the disadvantage of requiring a separate locking pin to be inserted at each corner of each shelf. Furthermore, each shelf corner needs to be moved towards a corresponding upright in a horizontal direction (i.e. perpendicular to the axis of the upright) in order for the angle piece to be received in the apertures, and it is likely to be difficult to insert extra shelves after the uprights have been fixed in position relative to each other by the mounting of one or more previous shelves.

Systems have also been proposed which avoid the use of external attachment means by having interacting engagement means which are integral with the uprights and shelves. A typical example of a prior art system of this type is described in British Patent Application No. 2,260,480. In the arrangement described in this document, each shelf corner has a pair of outwardly facing vertically spaced studs. Each stud has a wide head portion, attached to the shelf by a narrower neck portion. The uprights are provided with vertically spaced key-hole shaped apertures, each having a wide upper portion to permit passage therethrough of a stud head, and a narrower slot extending downwardly therefrom, the slot being of a width sufficient to receive a stud neck portion but insufficient to permit passage of the stud head. Each shelf corner is mounted to an upright by inserting the stud heads through the wide upper portions of corresponding key hole shaped apertures, and moving the shelf downwardly with respect to the upright to lock the studs in position. Again, this system requires the shelf to be brought up to the support in a direction perpendicular to the axis of the support, and the studs and apertures need to be carefully aligned manually before engagement.

SUMMARY OF THE INVENTION

In a broad sense, the present invention provides a shelving system which can be constructed solely from upright supports and shelves or other transverse members, without the need for external attachment means, which provides for ready positioning of the shelves with respect to the supports, and in which the shelves may be mounted to the supports by movement substantially only in a vertical direction (i.e. generally parallel to the supports).

In a more specific aspect, the invention provides shelving apparatus comprising: one or more support members adapted to extend substantially vertically in use; and at least one transverse members adapted to be supported by said support members; each support member comprising two substantially planar walls joined along a common edge to form an apex, and having at least one slot defined by a retention member disposed within the included angle formed by said walls, the slot having limbs extending generally parallel to both of said walls; said at least one transverse member being provided at at least one corner thereof with a depending engagement member, adapted to be received in a said slot; whereby said corner of said transverse member may be mounted to a respective support member by locating the engagement member in the apex formed by the walls of the support member, at a position above the slot, and moving the engagement member downwardly with respect to the support member so that it becomes engaged in and is retained by said slot.

Conveniently, the support members may be manufactured from sheet steel or other suitable stock material, bent to form a member having a generally "L"-shaped cross-section using conventional machinery. The retention member defining the slot may be formed from the material of the support by a punching technique, or may be manufactured separately and attached to the inner surface of the support member, for example by welding or by use of a suitable adhesive substance. Preferably, the retention member follows the contour of the apex of the support member, so that a slot of generally "L" shape is formed.

Each shelf (or transverse member) may also be manufactured from sheet steel or other suitable stock material. Usually each shelf will have a short downwardly extending peripheral skirt, which may be formed by bending the edge portions of a suitable blank, using conventional machinery. The engagement members may be integrally formed from the same sheet of stock material, but this may require an unnecessarily complex blank. It is therefore a preferred option to manufacture the engagement members separately, and to attach these to the corners of the shelf, for example by welding or with a suitable adhesive substance. Using separate engagement members and attaching portions thereof to at least two non-coplanar walls of the shelf has the advantage of stiffening and strengthening the corner of the shelf.

The engagement members may have any shape that will mate with the slots in the uprights. Preferably, their outer profiles correspond to the inner profiles of the apex region of the support member, so as to facilitate proper location of the shelf corners with respect to the supports before insertion of the engagement members in the slots. Preferably, the slots are open at both ends and the engagement members are longer than the slots (in the axial direction of the support member), so that engagement members extend through the entirety of the slots, and protrude from their lower ends. This arrangement is preferred as it affords maximum firmness, and is essential in embodiments in which the slots are formed by retention members punched from the material of the uprights, as the inward displacement of the retention members in such embodiments leaves corresponding apertures in the outer surfaces of the supports. These apertures must be traversed by the engagement members, the lower ends of which must extend to engage and be supported by portions of the supports immediately below the apertures.

Although it is assumed that the main use for the invention will be in shelving units having rectangular shelves ounted to a support at each corner, the invention is not restricted no the use of rectangular shelves, or even to the use of shelves at all. Embodiments of the invention are suitable for use with any member which requires to be supported in a generally transverse orientation with respect to a support. The number and configuration of the supports and engagement members may be chosen to meet the needs of any particular application, and it is anticipated that the strength of the joint formed between the engagement member and slot is such that in some instances a transverse member may be supported by an engagement member mounted to a single support.

BRIEF DESCRIPTION OF THE DRAWINGS

The invention is hereinafter described in more detail by way of example only, with reference to the accompanying drawings, in which.

DETAILED DESCRIPTION OF THE PREFERRED EMBODIMENTS

Figure 1:
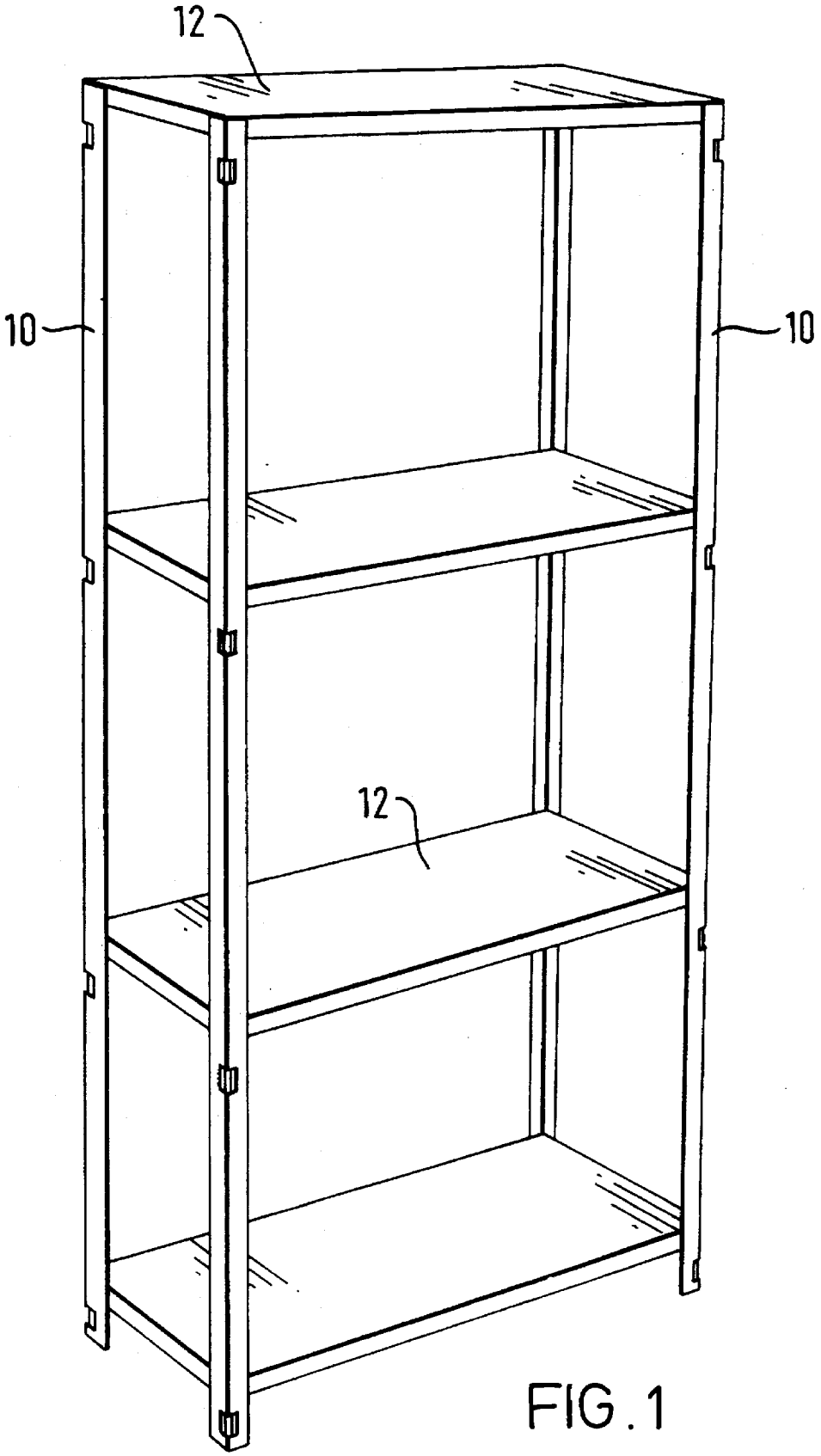
FIG. 1 is a perspective view of an embodiment of shelving apparatus according to the invention, shown assembled.

FIG. 1 shows an assembled shelving unit composed of four supports 10 and four shelves 12 mounted to the supports. Each of the supports in manufactured from an elongate sheet (conveniently of steel), which is bent through approximately 90° along a longitudinal axis to form a member of substantially uniform generally "L"-shaped cross-section defined by walls 14*a* and 14*b*.

Figure 2:
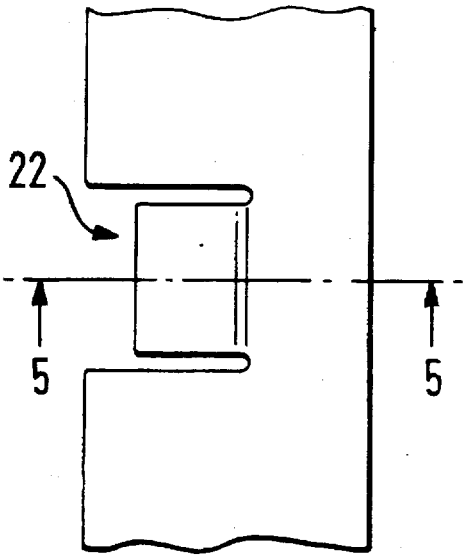
FIG. 2 is a side elevational view of a portion of a support member of the FIG. 1 embodiment, showing a retention member.
Figure 4:
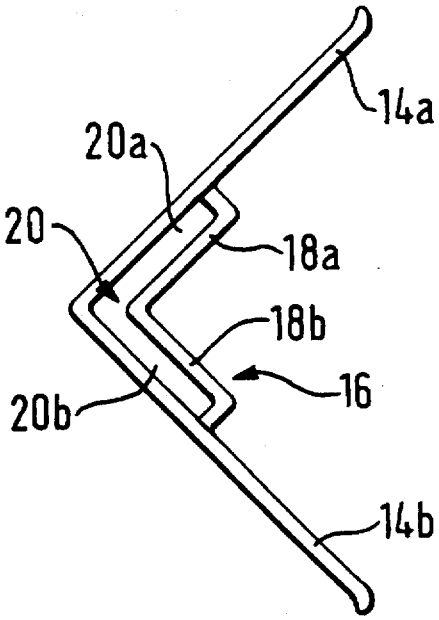
FIG. 4 is a top plan view of a support member of the FIG. 1 embodiment.
Figure 5:
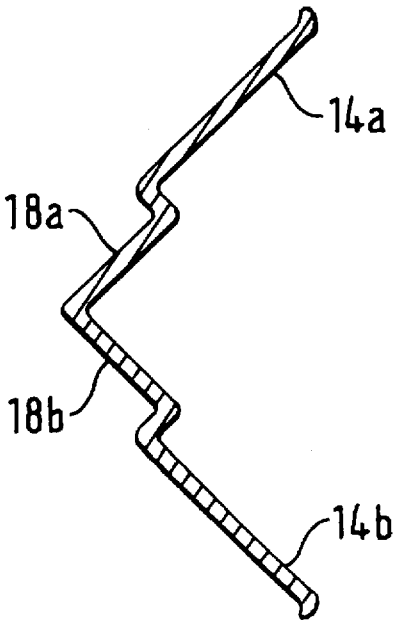
FIG. 5 is a sectional view taken along line 5—5 of FIG. 2.

Retention members 16 (see FIG. 4) are disposed at intervals along the length of each support 10, within the included angle formed by walls 14*a* and 14*b*. Each retention member comprises walls 18*a* and 18*b*, which lie in planes parallel to walls 14*a* and 14*b*, thereby forming slot 20 of generally "L"-shaped cross section, having limbs 20*a* and 20*b* parallel to walls 14*a* and 14*b* of support 10 respectively. Each retention member 16 is formed from the material of the support by a conventional punching technique, which leaves aperture 22 in the support (see FIG. 2).

Figure 6:
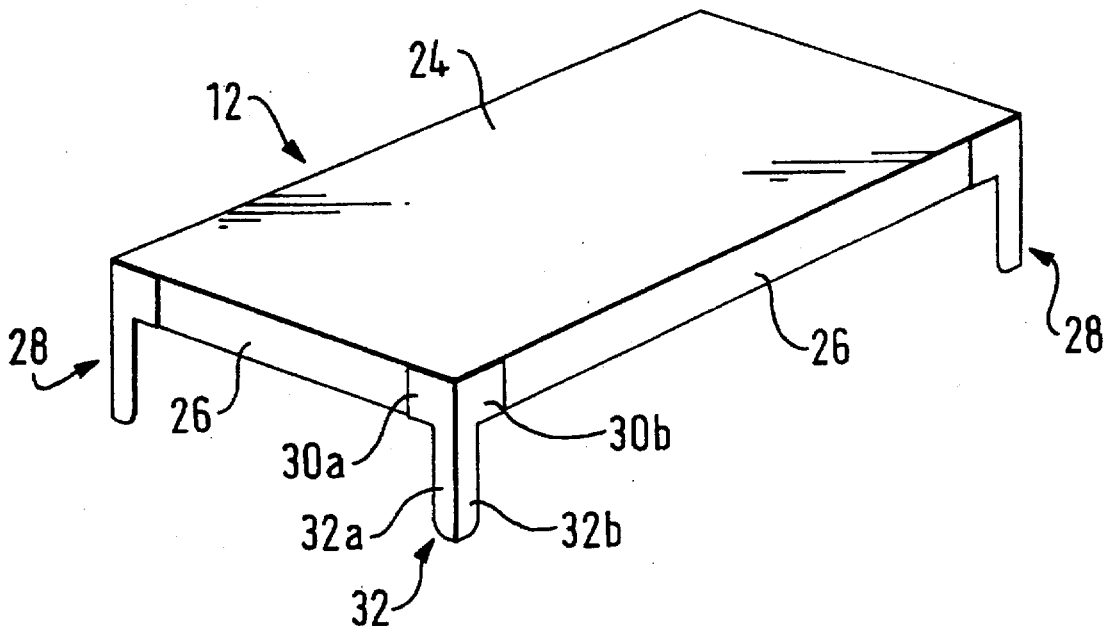
FIG. 6 is a perspective view of a shelf of the FIG. 1 embodiment.

The structure of a preferred shelf 12 is shown in FIG. 6, and comprises platform 24, depending peripheral side walls 26, and corner brackets 28. Conveniently, the shelf is manufactured from a planar blank of sheet steel, having a central portion corresponding to platform 24, and peripheral tabs which are subsequently bent through 90° to form side walls 26. In the embodiment illustrated in FIGS. 3 and 6, the brackets 28 are manufactured separately from the blank, (though conveniently from the same sheet steel stock) and are of generally "T"-shape. A bend of approximately 90° is imparted to each bracket along its axis of symmetry to conform to the shape of the shelf corners, and each is attached to a shelf corner by welding or adhering arms 30*a* and 30*b* to adjacent shelf side walls 26. The lower portion of each bracket 28 forms an engagement member 32, having walls 32*a* and 32*b* adapted to be received in limbs 20*a* and 20*b* respectively of slot 20.

Figure 8:
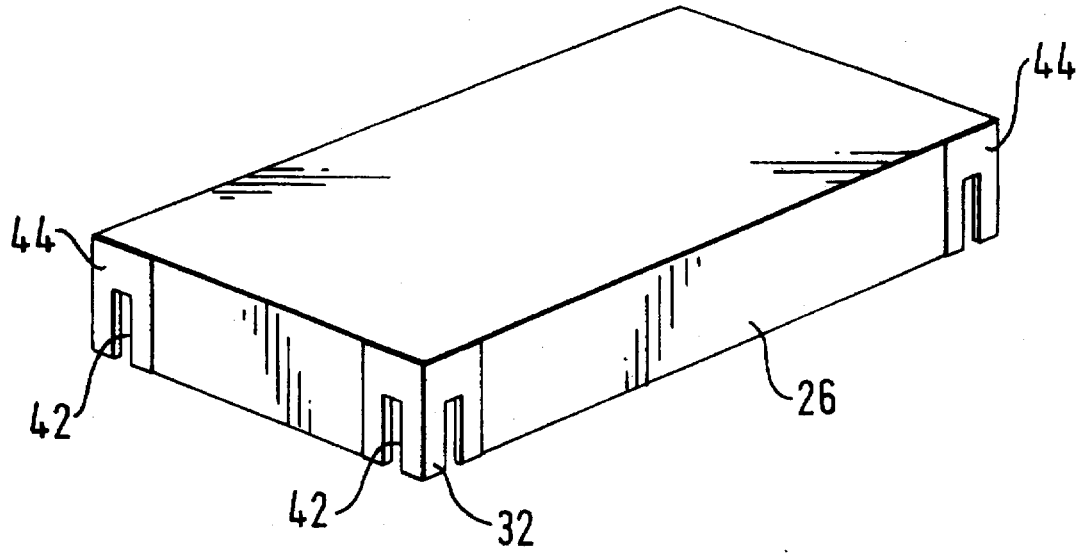
FIG. 8 is a perspective view of an alternative embodiment of shelf.

In an alternative embodiment (see FIG. 8), the shelf side walls 26 extend downwardly to the same degree as the engagement members 32, and the engagement members are separated from the side walls by vertical slots. In this embodiment, the shelf corner brackets 44 are generally "M" shaped before being bent through 90°.

Figure 3:
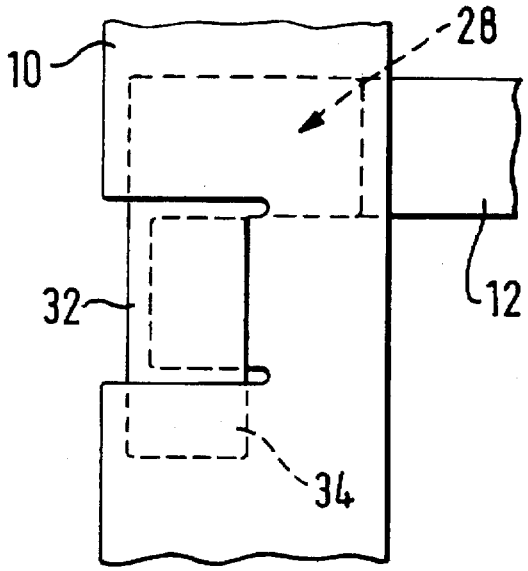
FIG. 3 is a side elevational view corresponding to FIG. 2, showing a shelf corner mounted to the support member, with hidden lines ghosted.

In use, each corner of the shelf 12 is mounted to a support 10 by first locating the engagement member 32 of the corner bracket 28/44 in the apex formed by walls 14*a* and 14*b* of support 10 at a position above slot 20, and then moving shelf 12 downwardly with respect to support 10 to the position shown in FIG. 3, in which engagement member 32 is engaged in slot 20. As illustrated in FIG. 3, engagement member 32 is longer (axially) than aperture 22 in the outer wall of support 10, so that the lowest portion 34 thereof is supported by a portion of the support below the aperture.

Figure 7:
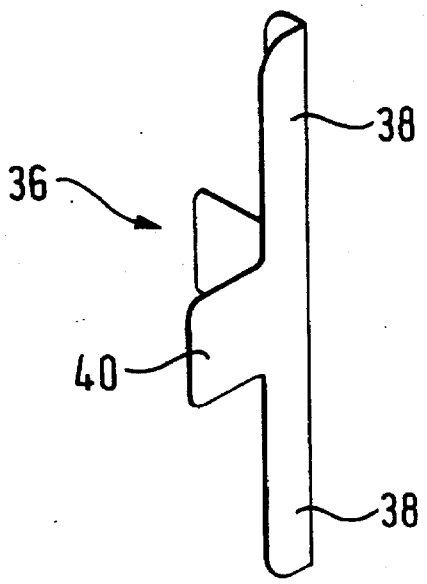
FIG. 7 is a perspective view of a double corner bracket joining piece for joining two support members in an alternative embodiment of apparatus according to the invention.

Optionally apparatus according to the invention may also comprise joining pieces for attaching two supports to each other to produce a support of increased height. The joining piece 36 illustrated in FIG. 7 has the form of a double corner bracket comprising upwardly and downwardly extending engagement members 38 for location in corresponding slots positioned close to the ends of two separate support members, and stop member 40 for preventing further relative movement of the engagement members and supports in the respective insertion directions, when the engagement members are fully engaged in the slots.

Figure 9:
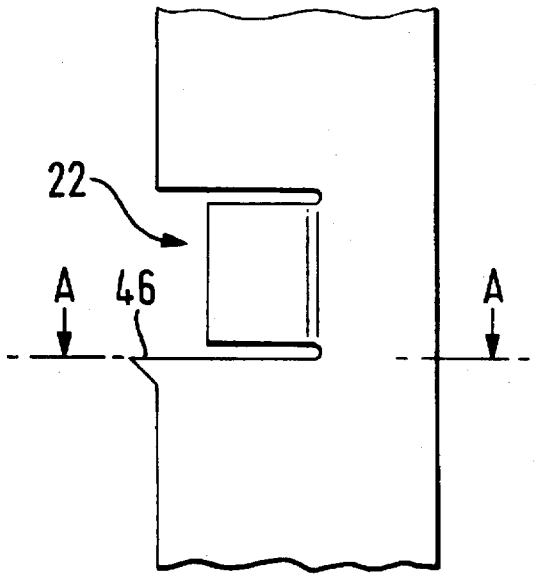
FIG. 9 is a side elevational view of a portion of an alternative embodiment of support member.
Figure 10:
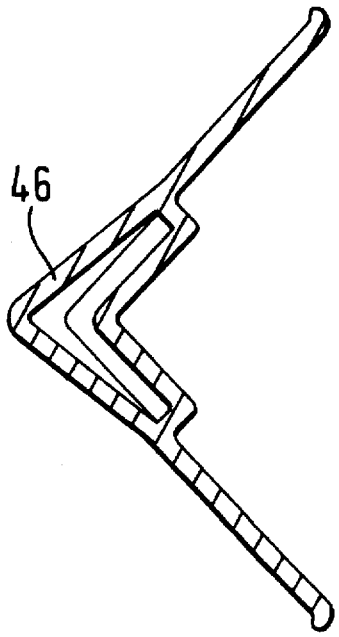
FIG. 10 is a sectional view taken along line A—A of FIG. 9.

FIGS. 9 and 10 illustrate a modified form of support, in which the lower edge of each aperture 22 is provided with a lip 46, the purpose of which is to facilitate the insertion of engagement member 32 and to guide this into the position shown in FIG. 3. As an alternative or additional aid to insertion of the engagement members, these may be tapered (not illustrated). In a particularly preferred embodiment, shelves having tapered engagement members 32 are used in conjunction with supports having lips 46, the leading point of each tapered engagement member being at the apex of the "L" shaped member, so as to coincide with the widest part of the lip.

While certain preferred embodiments of the invention are described herein in detail, numerous modifications, alterations, alternative embodiments and alternative materials will suggest themselves to those skilled in the art. It is intended that all such modifications should be considered as being within the spirit and scope of the invention, and to be encompassed by the appended claims.

What is claimed is:

1. Apparatus comprising:

one or more support members adapted to extend substantially vertically in use;

and at least one transverse member having a corner to engage each support member and adapted to be supported by said support members;

each support member comprising two substantially planar walls joined along a common edge to form an apex, and having at least one slot defined by a retention member disposed within the apex formed by said walls, the slot having limbs extending generally parallel to both of said walls and being open at upper and lower ends;

said at least one transverse member being provided at at least one corner thereof with a depending engagement member, adapted to be received in the upper end of a said slot and to protrude from the lower end thereof and to be supported by a portion of the support below the slot;

whereby said corner of said transverse member may be mounted to a respective support member by locating the engagement member in the apex formed by the walls of the support member, at a position above the slot, and moving the engagement member downwardly with respect to the support member so that it becomes engaged in and is retained by said slot.

2. Apparatus according to claim 1, wherein said retention member follows the apex of the support member, so that a slot of generally "L"-shape is formed.

3. Apparatus according to claim 2, wherein the retention member is formed from the support by wall segments punched out of said support and parallel to said substantially planar walls.

4. Apparatus according to claim 1, wherein the engagement member has an outer profile and the support member has an inner profile which corresponds to the outer profile of the engagement member which is mounted thereon.

5. Apparatus according to claim 1, wherein said engagement member is attached to a said transverse member by welding or adhering portions of said engagement member to at least two non-coplanar walls of said transverse member.

6. Apparatus according to claim 1, further comprising at least one joining piece for joining two longitudinally-aligned separate supports together to produce a support of increased height.

7. Apparatus according to claim 6, wherein said at least one joining piece comprises upwardly and downwardly extending engagement members, said separate supports having corresponding slots positioned close to the ends thereof, said joining piece has at least one stop member located between said upwardly and downwardly extending engagement members and protruding from said joining piece for preventing further relative movement of the engagement members and supports in the respective insertion directions, when the engagement members are fully engaged in the slots.

8. Apparatus according to claim 1, wherein the lower end of said at least one slot of said support member is provided with an outwardly directed lip protruding from said support member to assist insertion of a corresponding engagement member by guiding said corresponding engagement member past said lower end.

9. Apparatus according to claim 1, wherein the engagement members are tapered.

* * * * *

UNITED STATES PATENT AND TRADEMARK OFFICE

CERTIFICATE OF CORRECTION

PATENT NO. : 5,685,238

DATED : November 11, 1997

INVENTOR : David Anthony Chambers

It is certified that errors appear in the above-identified patent and that said Letters Patent is hereby corrected as shown below:

Column 1, line 45, change "piece" to --pieces--;

Column 3, line 13, "ounted" should be --mounted--;

line 14, "no" should be --to--.

Signed and Sealed this

Third Day of February, 1998

*Attest:*

Bruce Lehman

BRUCE LEHMAN

*Attesting Officer*

*Commissioner of Patents and Trademarks*